US005136858A

United States Patent [19]

Bruner

[11] Patent Number: 5,136,858

[45] Date of Patent: Aug. 11, 1992

[54] OPENABLE RING WITH INTERLEAVING MEMBER

[76] Inventor: Mates A. Bruner, 14 Barbara La., Havertown, Pa. 19083

[21] Appl. No.: 695,371

[22] Filed: May 3, 1991

[51] Int. Cl.[5] ..... A44C 9/00

[52] U.S. Cl. ..... 63/15.7; 63/7; 24/650

[58] Field of Search ..... 63/15, 15.7, 7, 3, 2, 63/15.5; 24/647, 650

[56] References Cited

U.S. PATENT DOCUMENTS

| | | | |
|---|---|---|---|
| 145,788 | 12/1873 | Cottle . | |
| 276,091 | 4/1883 | Spicer | 63/7 |
| 499,928 | 6/1893 | Oppenheimer | 63/15.7 |
| 804,137 | 11/1905 | Kent . | |
| 1,003,696 | 9/1911 | Briggs . | |
| 1,296,435 | 3/1919 | Schmidt . | |
| 2,045,282 | 6/1936 | Metcalf . | |
| 2,582,083 | 6/1952 | Tarter | 63/15.7 |
| 3,204,426 | 9/1965 | Armstrong . | |
| 3,221,514 | 12/1965 | Newman . | |
| 3,465,563 | 9/1969 | Verdickt . | |
| 3,736,770 | 6/1973 | Kelrick . | |
| 4,879,883 | 11/1989 | Bruner . | |
| 4,991,409 | 2/1991 | Creates | 63/15.7 |

FOREIGN PATENT DOCUMENTS

| | | | |
|---|---|---|---|
| 7507499 | 3/1975 | France . | |
| 87327 | 1/1958 | Netherlands . | |
| 21739 | of 1893 | United Kingdom | 24/650 |
| 584404 | 1/1947 | United Kingdom | 63/15.7 |

*Primary Examiner*—Renee S. Luebke
*Assistant Examiner*—F. Saether
*Attorney, Agent, or Firm*—Caesar, Rivise, Bernstein, Cohen & Pokotilow, Ltd.

[57] ABSTRACT

A ring to be worn as an article of jewelry about a portion of a body of a person includes first and second arcuate sections pivotally interconnected at one end for permitting pivotal movement of the arcuate sections between opened and closed positions. Latching members are included on each arcuate section. The latching members on one arcuate section include an elongate tongue and a pair of locking extensions located on opposite sides of the tongue, each locking extension including male and female connecting sections. The latch members on the other arcuate section include a pair of locking extensions located on opposite sides of a central bridge section, and these locking extensions include male and female connecting sections for engaging with the male and female connecting sections of the one arcuate section. The other arcuate section includes a safety latch which automatically is pivoted into an overlapping position with a raised projection on the tongue when the ring is moved into a closed position, with a section of the tongue underlying both the bridge section and the safety latch, and with the locking extensions on the one arcuate section engaging corresponding locking extensions on the other arcuate sections.

27 Claims, 6 Drawing Sheets

OPENABLE RING WITH INTERLEAVING MEMBER

BACKGROUND ART

This invention relates generally to ring-like objects designed to be worn as jewelry, and more particularly to rings which are enabled to be releasably opened for fitting about a portion of the wearer's body, e.g., finger, which are resistant to accidental opening, and which are easily opened when desired.

Conventional finger rings or other jewelry arranged to be worn about a portion of the body must have a sufficient diameter to slide over the knuckle or other bony protuberance adjacent the point at which the ring is to be worn. Normally, such action does not present any problem since the difference in diameter between the bony protuberance, e.g., knuckle, and the portion on which the ring is worn is sufficiently small so that a properly fitting ring is comfortable to wear, to put on and to remove. However, there are numerous individuals who, for a variety of reasons, such as bone fractures, arthritis, etc., have enlarged knuckles or other protuberances, which prevent their wearing of conventional jewelry.

The prior art includes adjustable, expandable and openable jewelry rings. For example, some of the prior art discloses rings which are adjustable in size through a specific range. Such rings are limited to a fixed expansion and are adapted to permanently remain in one particular size. They are also generally constructed so that they can expand only to a limited degree, thus limiting the size of a knuckle or other protuberance over which they may be fit.

The prior art also discloses openable rings having exposed latching members that easily can be opened by a person's finger, to thereby permit repeated opening of the ring. Because these rings have exposed latching members that are designed to be opened by the modest downward force imparted by a person's finger, they inherently lack the desired durability and safety against self-opening.

There are a variety of other openable ring constructions which have been disclosed in the prior art. A number of the ring constructions employ, as part of the locking or latching system, a separate spring member. The use of a separate spring can increase the fabrication and material costs of the ring, since the spring element is made separate from the ring, and then needs to be affixed to the remainder of the ring structure. In addition, resilient spring members often tend to lose their resiliency, and in prior art constructions employing such spring members, a loss of resiliency may adversely affect the locking capabilities of the construction.

In a variety of prior art structures the latching mechanisms are quite bulky and unsightly, and therefore are not readily adaptable for use on high quality jewelry made of precious metals, such as gold and silver. Still other latching assemblies constitute a point of weakness which is readily susceptible to being deformed under bending stresses of the type which normally are encountered by the wearer of the ring. Still other prior art structures are somewhat difficult to use, requiring substantial manual dexterity in order to properly close the ring, and, when desired, to open the ring.

Examples of prior art adjustable or openable ring-like jewelry are found in Netherlands Patent No. 87,32 (Goldrick); French Patent No. 75 07499 (Algier) and the following U.S. Pat. Nos. 145,788 Cottle); 804,137 (Kent); 1,003,696 (Briggs); 1,296,435 (Schmidt); 2,045,282 (Metcalf); 3,204,426 (Armstrong); 3,221,514 (Newman); 3,465,563 (Baker), 3,736,770 (Kelrick) and 4,879,883 (Brunner).

While some prior art ring structures may be generally suitable for their intended purposes they still leave much to be desired from the standpoint of utility, ability to provide an aesthetically pleasing appearance, ease of closing and locking, resistance to bending, resistance to accidental opening and/or ease of opening.

OBJECTS OF THE INVENTION

It is a general object of this invention to provide an openable ring which is reliable in operation and easy to use.

It is a more specific object of this invention to provide an openable ring having a safety latch construction which is not susceptible to inadvertent opening.

It is a further object of this invention to provide an openable ring construction including a safety latch mechanism designed to release under a pulling force or pressure, to prevent serious injury to the wearer's finger.

It is a further object of this invention to provide an openable ring construction which is resistant to deformation by bending stresses.

It is a further object of this invention to provide an openable ring structure which does not rely upon external spring elements to provide a locking function.

It is a further object of this invention to provide a ring construction which relies upon the inherent spring tension of the material of the ring to assist in maintaining the ring in a closed, or latched condition.

It is a further object of this invention to provide an openable ring structure which has an aesthetically pleasing appearance, without any unsightly bulging and/or projecting elements.

SUMMARY OF THE INVENTION

The above and other objects of this invention are achieved in a ring intended to be worn as an article of jewelry about a portion of the body of a person. The ring includes first and second, rigid arcuate sections pivotally interconnected at one end for permitting pivotal movement of the arcuate sections between opened and closed positions. The arcuate sections, at the ends opposite the pivotal connection, each include latching members for cooperating with the latching members of the other arcuate section for releasably retaining the arcuate sections in a closed position. The arcuate sections, in a closed position, define a closed ring having a closed, interior passage for receiving a portion of a body (e.g., the finger of a person), said closed passage being provided by the inner surfaces of the arcuate sections and some of the latch members. The closed ring has an outer closed surface provided by outer surfaces of the arcuate sections and some of said latch members, and side surfaces defining the width of the ring, provided by side surfaces of the arcuate sections and some of said latch members.

In the preferred form of this invention the latch members on one of the arcuate sections are unitarily formed as part of that arcuate section and include an elongate tongue constituting a continuous section of said arcuate section, said tongue terminating at a distal end and being narrower than the closed ring, and a pair of locking extensions located on opposite sides of the tongue. Each locking extension has a distal end which is located proximal of the distal end of the tongue and includes male and female connecting sections.

The latch members on the other arcuate section include a pair of transversely spaced-apart locking extensions unitarily formed as part of the arcuate section, with each of the locking extensions including male and female connecting sections; a bridge section unitarily formed as part of the arcuate section and constituting an extension of, and being joined to transversely spaced-apart, facing sidewalls of the pair of transversely spaced-apart locking extensions; and a safety latch pivotally mounted between said pair of transversely spaced-apart locking extensions in a location proximally of the bridge section.

Each locking section of one of the pair of locking extensions of one arcuate section is transversely aligned with a respective locking extension of the other pair of locking extensions on the other arcuate section for causing the female and male connecting sections of each of the transversely aligned locking extensions to interlock, respectively with the male and female connecting sections of the other of said transversely aligned locking extensions, when the ring is closed. In addition, the safety latch is movable about its pivotal mounting between opened and closed positions, and the latch, in its closed position, has a distal end extending distally of the bridge member and being located in radial overlying relationship with a surface of the tongue for precluding inadvertent opening of the closed ring. The safety latch includes a section located proximally of pivotal mounting of the safety latch and proximally of the bridge member for engaging with the distal end of the tongue when the ring is in a closed position, whereby spring tension inherent in the tongue aides in maintaining the safety latch in a closed position.

In a preferred embodiment of the invention the safety latch also includes a downwardly projecting section adjacent the pivotal mounting and in close, contiguous relationship to the upper surface of the tongue for cooperating with the tongue to resist bending stresses of the type normally encountered when the ring is being worn.

In a preferred embodiment of the invention the bridge member includes an outer surface located radially inward of the outer surface of the closed ring, said outer surface of the bridge member underlying the safety latch in a region distally of the pivot mounting thereof for engaging and limiting movement of the safety latch when the latch is moved into its closed position. The safety latch, in its closed position, includes an outer surface constituting part of the outer surface of the closed ring.

In the preferred embodiment of this invention the bridge member includes a surface for frictionally engaging with a surface of the safety latch, when the safety latch is in an opened position, to assist in retaining the safety latch in an opened position, until the ring is intended to be closed, at which time the tongue on one of the arcuate sections cooperates with the safety latch to automatically force the safety latch into a closed and locked position as the arcuate sections of the ring are moved into their closed position.

In the most preferred embodiment of this invention the tongue is located inwardly of the bridge member and includes an inner surface constituting part of the inner surface of the closed ring.

In the preferred embodiment of this invention the safety latch includes a release section disposed proximally of the pivot mounting, said release section being engagable by an instrument for pivoting the safety latch into an opened position. This pivotal movement of the safety latch forces the distal end of the tongue engaged thereby in a direction for opening the ring, wherein the interlocking connection between the pairs of locking extensions is disengaged, but not completely separated, for permitting the ring to be easily opened, by the wearer manually gripping and pulling the arcuate sections apart.

Most preferably the locking extensions of each pair are positioned so as to cause the male connecting section of each locking extension to flex slightly into snapping, interlocking engagement with a female connecting section of a cooperating locking extension when the arcuate sections of the ring are moved into a closed position. Thus, the cooperation between the male and female connecting sections of the locking extensions provide a tight locking connection for the arcuate sections.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein.

DETAILED DESCRIPTION OF THE BEST MODE OF THE INVENTION

Figure 1:
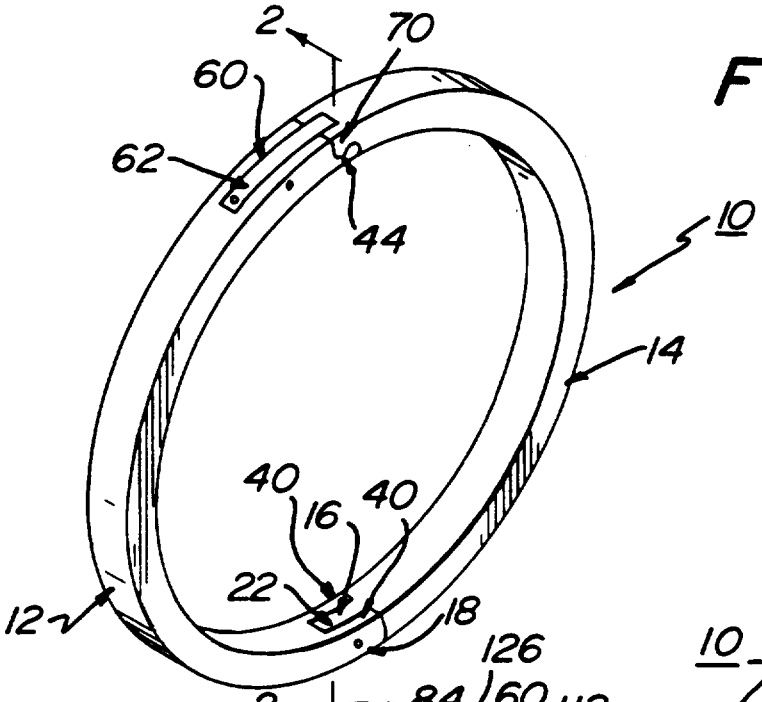
FIG. 1 is an isometric view of the ring of this invention in its closed position.

Referring now to the various figures of the drawing wherein like reference characters refer to like parts, an openable ring with a unique latch mechanism is generally shown at 10 in FIG. 1. The device 10 basically comprises a pair of arcuate sections 12 and 14 pivotally interconnected through a hinge connection 16 adjacent one of their contiguous ends, and including a unique latch mechanism 60 adjacent their opposite contiguous ends.

Figure 7:
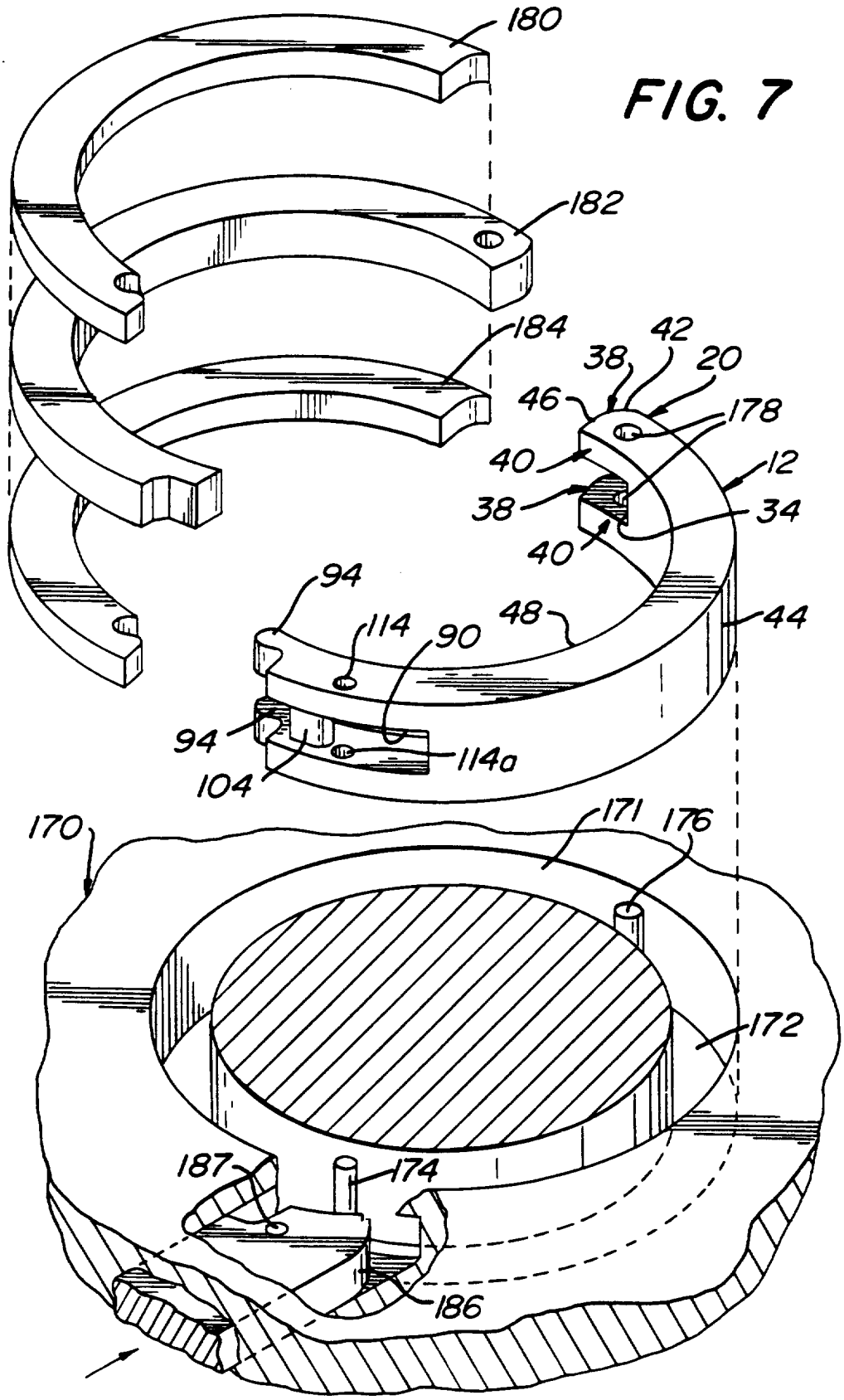
FIG. 7 is a schematic, fragmentary, exploded isometric view of mold sections employed in forming a wax impression of one of the arcuate ring sections and also the wax impression so formed.
Figure 8:
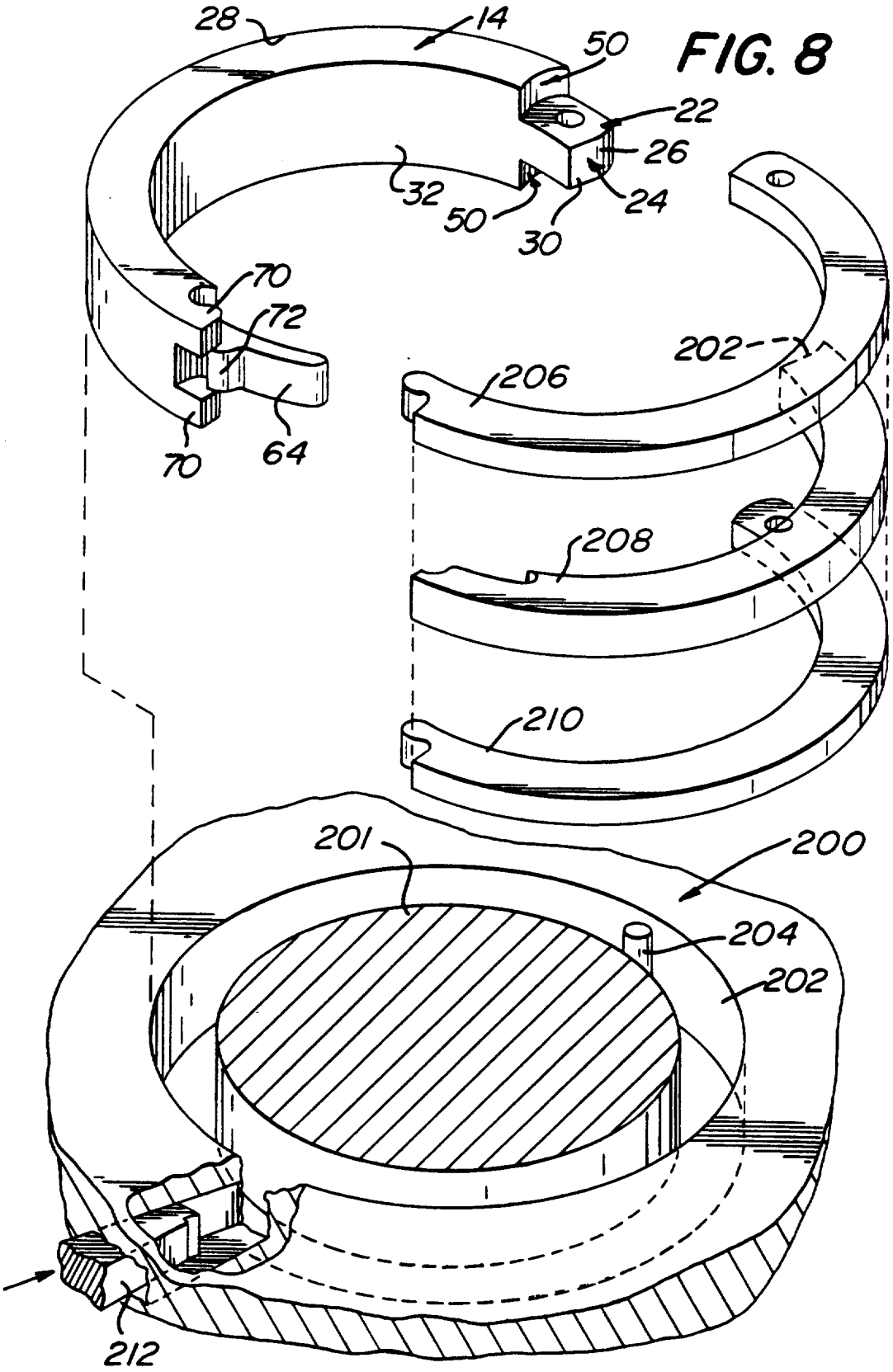
FIG. 8 is a schematic, fragmentary, exploded isometric view of mold sections employed in forming a wax impression of the other arcuate ring section and also the wax impression so formed.

Referring specifically to FIGS. 1, 7 and 8, the hinge connection 16 includes a hinge pin 18 extending through aligned openings in yolk 20 of section 12 and tang 22 of section 14. At this point it should be noted that the ring sections 12 and 14 are preferably made of a precious metal, i.e., gold, and are formed from wax impressions of the ring sections in a conventional investment casting operation. The sections 12 and 14 illustrated in FIGS. 7 and 8 actually are the wax impressions which ultimately are employed to form the identically-shaped arcuate sections 12 and 14 of the metal ring 10. For this reason the parts of the wax impressions illustrated in FIGS. 7 and 8 will be identified by the same numerals used to identify the metallic form of the product, resulting from investment casting with the wax inserts.

Figure 2:
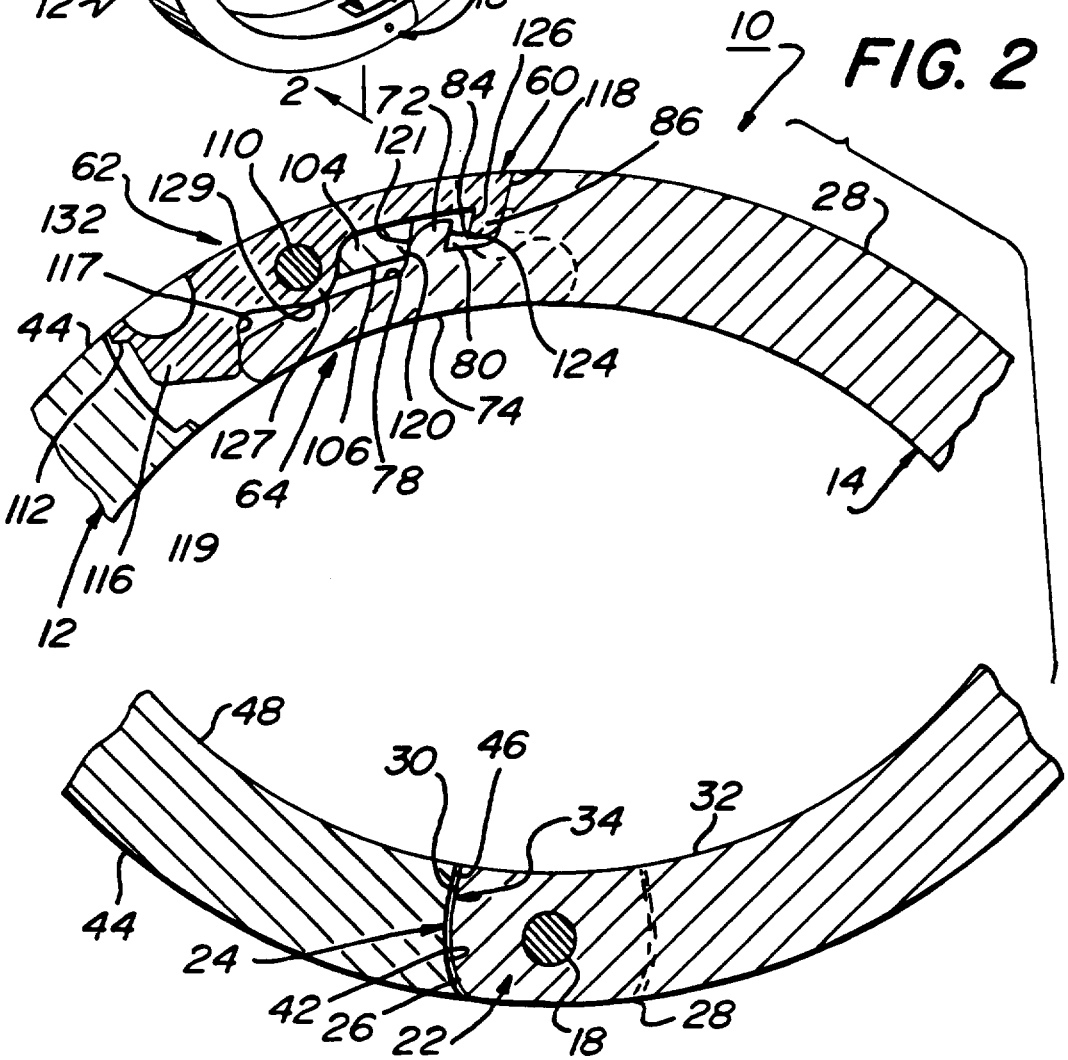
FIG. 2 is a fragmentary sectional view taken along line 2—2 of FIG. 1, showing the arrangement of the unique latch mechanism of this invention, in a closed position.

As can be seen best in FIGS. 2 and 8, the tang 22 has a distal surface 24 which includes a generally curved section 26, beginning at the outer surface 28 of ring section 14, and terminating in a substantially linear section 30 which extends to inner surface 32 of the ring section 14. This distal surface 24 matches with a complimentary-shaped surface 34 formed at the base of yolk 20 (FIGS. 2 and 7).

As can be seen best in FIGS. 2 and 7, distal surfaces 38 of each of the leg sections 40 of the yolk 20 have the same general configuration as the distal surface 24 of the tang 22 and the complimentary inner surface 34 formed at the base of the yolk 20, as described earlier. Specifically, the outer surfaces 38 include a generally curved section 42 beginning at the outer surface 44 of section 12, and a substantially linear section 46 which extends from the curved section 42 to inner surface 48 of the arcuate section 12. This outer surface 38 is contiguous to complimentary shaped, confronting surfaces 50 located adjacent each side of the tang 22, when the ring is in a closed condition (see FIG. 8).

The above construction of the hinge connection 16 provides an extremely rigid interconnection which resists undesirable bending forces which may be imposed upon the ring during use. Specifically, the cooperative relationships between contiguous, substantially linear sections of outer surfaces 24 of tang 22 and complimentary surface 34 at the base of yolk 20, and between the contiguous substantially linear sections of outer surfaces 38 of each of the leg sections 40 of the yolk 20 and the complimentary-shaped surfaces 50 adjacent each side of tang 22, resists deformation of the ring at the hinge connection 16, when the ring encounters compressive forces of the type experienced as the result of normal activities engaged in by the wearer of the ring. It should be noted that, in the preferred use of the ring 10, the arcuate section 14 constitutes the upper section of the ring, and the arcuate section 12 constitutes the bottom section of the ring. Thus, the hinge connection 16 and the latch mechanism 60 are located in a plane which generally passes through the wearer's fingers (e.g., in a plane substantially parallel to the front and back surfaces of the wearer's hand).

In the preferred embodiment of the invention the pivot pin 18 is riveted to the arcuate sections 12 and 14, by employing riveting rolls of the type manufactured by the Grant Manufacturing and Machine Company of Bridgeport, Conn. The use of these riveting rolls provides a non-obtrusive appearing, rigid connection which is particularly important in the formation of high quality rings made from gold and/or other precious metals.

Figure 3:
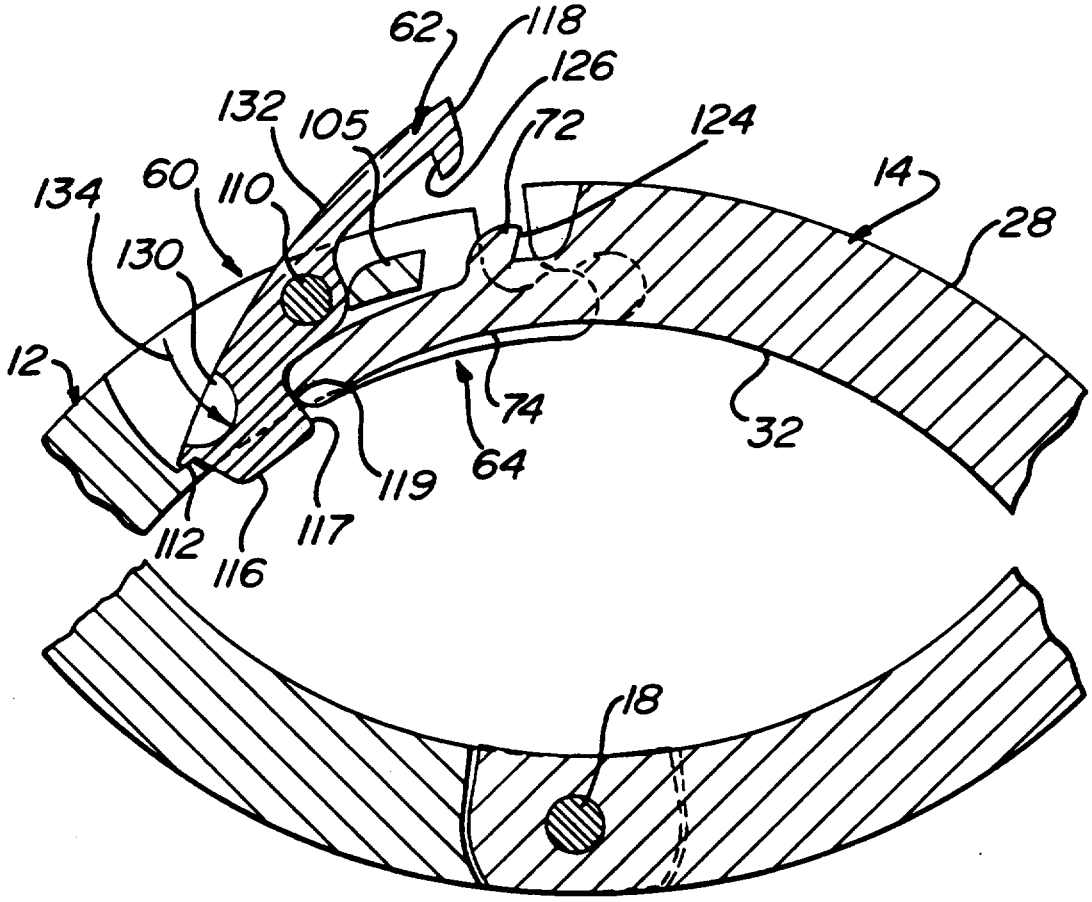
FIG. 3 is a sectional view similar to FIG. 2, but showing the arrangement of the latch mechanism and ring sections, after the latch mechanism has been depressed to open the ring sections.
Figure 4:
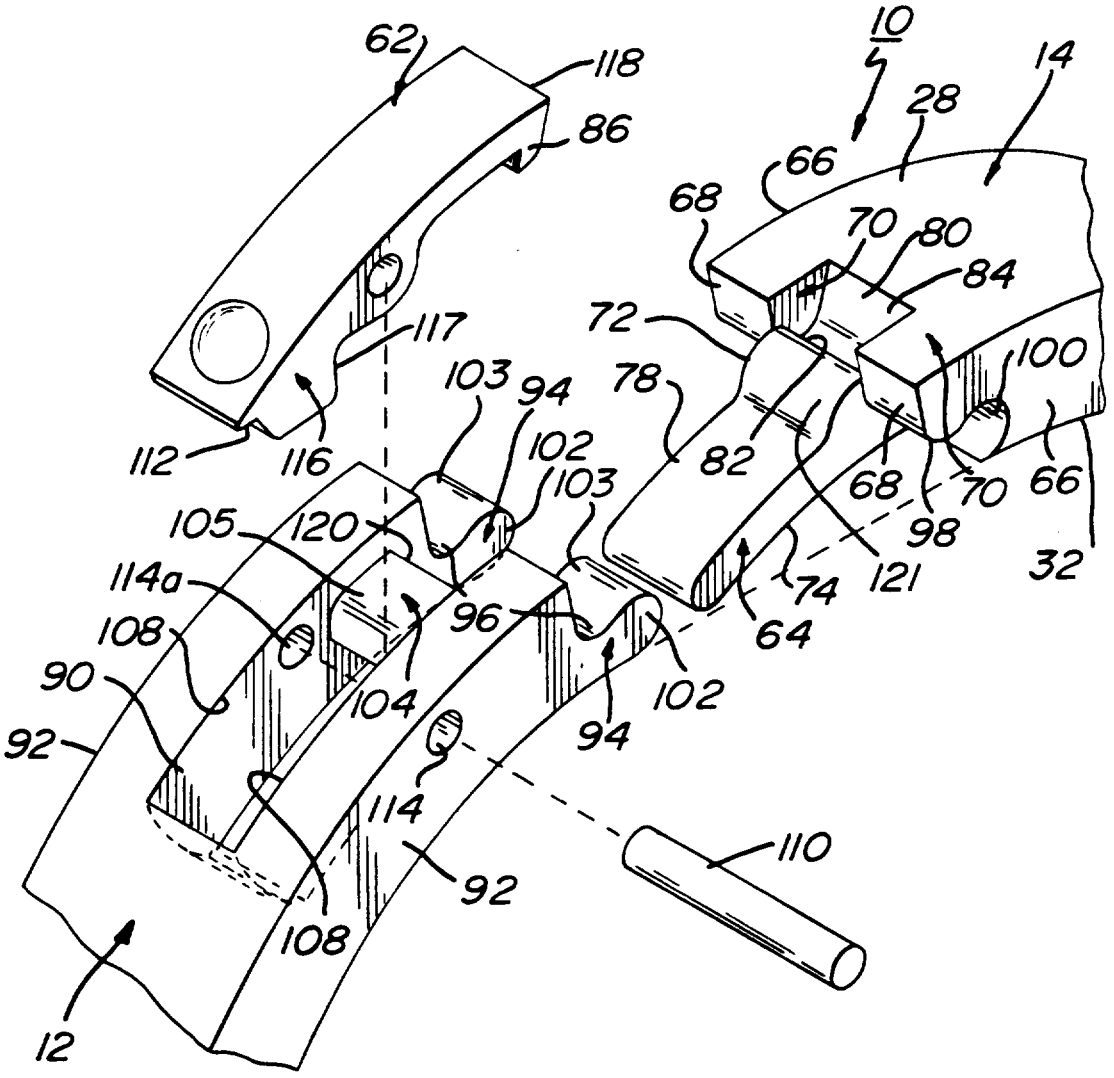
FIG. 4 is a fragmentary, exploded isometric view showing details of the unique latch mechanism of this invention.

Referring to FIGS. 2, 3 and 4, the unique latch mechanism 60 includes a safety latch 62 which is automatically moved into a locked position as the ring is moved into a closed position. The safety latch 62 also functions as a release mechanism for assisting in the opening of the ring, when it is desired to remove the ring from a person's finger.

As will be explained in greater detail hereinafter, the unique latch mechanism 60 employs a unique joint arrangement to maximize resistance against bending stresses, without the use of separate spring members. The unique latch mechanism 60 of this invention relies for its operation on the inherent spring tension within each of the arcuate sections 12 and 14; not upon the use of separate spring members which may fail in operation and which can add additional fabrication and material costs to the ring.

As can be seen best in FIG. 4, the latch mechanism 60 includes an elongate tongue 64 located centrally between sidewalls 66 of the arcuate ring section 14. The tongue 64 extends distally beyond end walls 68 of shorter, tongue and groove locking extensions 70 that straddle the tongue 64.

Still referring to FIG. 4 the tongue 64 has a raised shoulder 72 adjacent a proximal end thereof. The inner surface 74 of the tongue has substantially the same radius of curvature as inner surface 32 of the ring section 14, to thereby provide a substantially continuous smooth extension of said inner surface 32.

Since the tongue 64 is not as thick as the main body of the ring section 14, its outer surface 78 is spaced inwardly of the outer surface 28 of the main body of said ring section.

Figure 5:
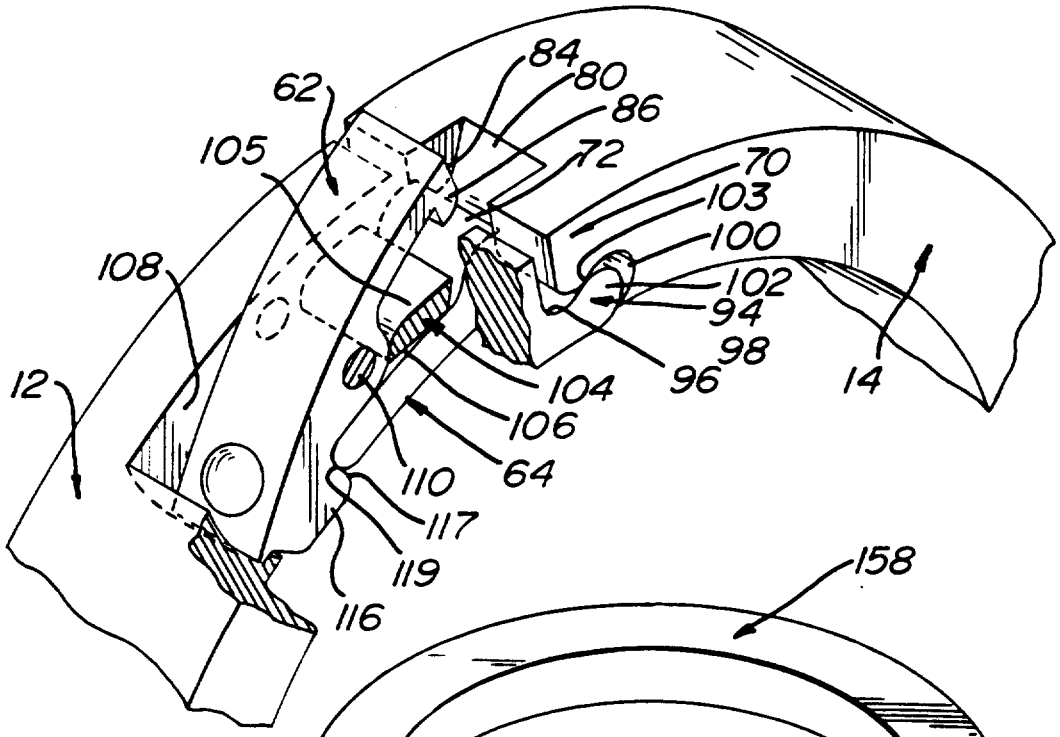
FIG. 5 is a fragmentary isometric view showing the arrangement of the latch mechanism with the safety latch thereof in an opened position.

Referring to FIGS. 2, 4, and 5, a transition surface 80, constituting the proximal end of the outer surface 78 of the tongue, actually meets with the outer surface 28 of the main body portion of the ring section 14. A proximally facing surface 82 (FIG. 4) of the shoulder 72 cooperates with the transition surface 80 to provide a relief-or recessed region 84 into which an inwardly directed nib 86 at the distal end of the safety latch 62 seats, when the ring is in a closed and locked condition (FIG. 2).

Referring to FIG. 4, the distal end of the ring section 12, opposite the yolk 20, includes a generally U-shaped recess 90 located centrally between outer side surfaces 92, to thereby provide transversely spaced-apart, tongue and groove locking extensions 94. These locking extensions are aligned to cooperate with the locking extensions 70 provided on a contiguous end of the arcuate ring section 14.

Still referring to FIGS. 4 and 5, each of the locking extensions 94 of arcuate section 12 includes an outwardly facing groove 96, which cooperates and lockingly engages with an inwardly facing tongue 98 of a cooperating locking extensions 70 forming part of the arcuate section 14. In addition, an inwardly facing groove 100 located on each of the locking extensions 70, at a location rearward or proximally of the inwardly facing tongue 98, lockingly engages with an outwardly facing tongue 102 of a cooperating locking extension 94, when the ring is in a closed position. Each of the tongues 102 is provided with a substantially flat, upper surface 103 (which can be provided with a file or other suitable tool) at which inwardly facing tongues 98 engage the outwardly facing tongues 102, when the safety latch 62 has been moved into a fully opened position, as is illustrated in FIG. 5. Thus, when the safety latch 62 is opened, the arcuate sections 12 and 14 will not "fly" apart, but rather will still remain connected to each other to prevent the ring from falling off, or separating from the user's finger, until such time as the user manually grasps one or both of the arcuate sections 12 and 14 to completely separate them.

The cooperative, locking engagement between the grooves 96 and tongues 102 of locking extensions 94, with complimentary shaped tongues 98 and grooves 100 of the locking extensions 70, takes place by a "snap action." That is, in order for the locking extensions 94 to actually engage and lock with the locking extension 70 it is necessary for the arcuate sections 12 and 14 to actually flex slightly, in order to permit the bulbous tongues 98 of locking extension 70 and bulbous tongues 102 of locking extension 104 to ride over each other and snap into the grooves 96 and 100, respectively. It should be noted that with the ring in a closed condition the confronting surfaces of grooves 96 and tongues 98, and the confronting surfaces of grooves 100 and tongues 98 are in engagement with each other to provide smooth, aesthetically pleasing outer side surfaces of the ring 10 (see FIGS. 1 and 2).

Referring to FIGS. 2, 4 and 5, a transversely extending bridge section 104 constitutes a part of the latch mechanism 60 and is unitarily formed between the locking extensions 94 of the arcuate section 12. This bridge section adds rigidity to the system, by actually providing a brace between the locking extensions. In addition, as can be seen best in FIG. 2, an upper surface 105 of the bridge section provides a support for the safety latch 62 when the safety latch is in a ring-locking position.

As can be seen best in FIG. 2, the bridge section 104 also includes a lower surface 106. This lower surface, in conjunction with inner side surfaces 108 of the recess 90 define a channel for receiving the elongate tongue 64 therein (see FIGS. 4 and 5). In addition, it should be noted that the lower surface 106 of the bridge section is spaced from the upper surface 78 of the elongate tongue 64 when the ring is in a closed position. The location of the bridge section 104 and tongue 64 to provide this spacing is required, to thereby permit relative radial movement to take place between the arcuate sections 12 and 14, for permitting the grooves 96 and tongues 102 of locking extensions 94 to "snap" into locking engagement with complementary shaped tongues 98 and grooves 100, respectively, of the locking extensions 70. Since the space between the lower surface 106 of the bridge section and the upper surface 78 of the tongue 64 is located in the interior of the ring, it is not visible, and therefore does not detract from the aesthetically pleasing appearance of the ring construction.

Referring to FIGS. 2 and 4, a pivot pin 110 of the safety latch 62 is located intermediate the inwardly directed nib 86 at the distal end of the latch, and an inwardly directed shoulder 112 of a nib located at the proximal end of the latch. The pivot pin 110 extends through an opening 114 provided through one of the tongue and groove extensions 94, and into an aligned, blind opening 114*a* extending only partially through the other of said extensions, from the inner side surface 108 thereof (FIG. 4). Thus, an end surface of the pivot pin 110 is only visible from one side of the ring, and the base of the blind opening 114*a* provides a surface for properly locating the pin relative to the other components of the ring.

Referring to FIGS. 2, 4, and 5, the safety latch 62 includes an inwardly projection section 116 adjacent the proximal end 112 thereof. This inwardly projecting section includes a generally distally facing surface 117 that cooperates with distal end 119 of the tongue 64, to automatically pivot the safety latch 62 in a clockwise direction, as viewed in FIG. 2, into the closed and locked position shown in FIG. 2.

Specifically, as the ring 10 is moved from its opened position, as is seen best in FIGS. 3, 4, and 5, into the closed position shown in FIG. 2, the distal end 119 of the tongue 64 engages the surface 117 of inwardly projecting section 116, causing the safety latch to rotate in a clockwise direction. Continuous movement of the ring sections into a closed position imposes a slight inwardly radial force on the tongue 64, causing the inherent spring tension within the tongue to impose an opposite, outward radial force on the inwardly projecting section 116 of the safety latch 62. In view of the fact that the inwardly projecting section 116 is located to the left of the pivot pin 110, as is viewed in FIGS. 2, 3 and 5, this outward, radial force maintains the safety latch 62 in its locked condition. In this locked condition distal surface 118 of the safety latch 62 is biased into a position closely adjacent the proximal portion transition surface 80 located proximal of the shoulder 72 of the tongue 64. This provides a generally aesthetically pleasing outer surface appearance, and generally eliminates exposed edge surfaces to irritate the finger adjacent the ring finger.

In the closed position of the latch 62, distally-facing surface 120 of the bridge section 104 is contiguous to a distally-facing surface segment 121 of the raised shoulders 72. In fact, in the preferred construction, the spacing between these latter surfaces 120, 122 is on the order of 0.002 inches.

It should be noted that the force biasing the safety latch into a closed position, resulting from the engagement of tongue 64 with the projecting section 116, is continuously maintained during a portion of the counterclockwise rotational movement of the safety latch in the direction of arrow 134 (FIG. 3). This arrangement precludes inadvertent opening of the safety latch 62, in that any slight, inadvertent, counterclockwise movement of the safety latch, in the direction of arrow 134, will not automatically open the safety latch. In fact, once the pressure or force is released, the normal spring tension imposed upon the projecting section 116 by the tongue 64 will automatically snap the safety latch back into its locking position. In other words, the cam arrangement provided by the interaction of the tongue 64 with the projection 116 will trigger an opening action at a depth of counterclockwise rotation, which only can be reached by the use of a separate implement, such as a pen or pencil, as will be described hereinafter.

Referring to FIGS. 2 and 3, when the safety latch 62 is in a closed condition a proximal-facing surface 124 of raised shoulder 72 of the tongue 64 is in radial overlapping relationship with a proximal-facing surface 126 of the inwardly directed nib 86 of the safety latch 62. The inherent spring tension of tongue 64 biases the safety latch 62 into a position wherein the radially overlapping surfaces 124, 126 are circumferentially spaced from each other. However, in the event that some of the "springiness" of the tongue 64 becomes degraded, thereby permitting some separation of the spring sections 12 and 14, the overlapping surfaces 124, 126 will engage each other, to thereby preclude the inadvertent, complete opening of the ring sections.

Although the safety latch 62 provides an extremely reliable locking function, the safety latch is capable of automatically moving into an opened position, in the event that any excessively high, abrupt, pulling force or pressure is imposed upon the ring, to thereby prevent serious injury to the wearer's finger. In fact, the sudden surge of a pulling force or pressure will trigger an opening of the ring, like a safety fuse that explodes under a surge of excess energy.

Referring specifically to FIG. 2, an important feature of this invention resides in the relationship between the tongue 64 and the safety latch 62, in the region of pivot pin 110. Specifically, a generally thickened section 127 in substantial radial alignment with the pivot pin 110 includes an inwardly facing surface 121 which is very closely positioned (on the order of 0.002 inches or less) to outer surface 78 of the tongue 64, when the ring is in a closed position.

When the ring is subjected to compressive loads of the type commonly encountered when the ring is being worn, the cooperation of forces provided by the cooperating tongue and groove connections of the locking extensions 70 and 94, respectively, in conjunction with the cooperation of forces provided by the engagement of the tongue 64, under resilient loading, with the surfaces 117 and 129 of the inwardly projecting section 116 and thickened region 127, respectively, of the safety latch 62, provides an intertwined joint that maximizes resistance against bending stresses.

As explained earlier, the arrangement of the connecting hinge section 116, and particularly the arrangement of cooperating linear surfaces associated with the yoke 20 and tang 22, also provides resistance against bending stresses encountered by the ring. Thus, this arrangement of the hinge connection 16, in conjunction with the cooperative arrangement between the various elements of the latch mechanism 60, as described above, provides an extremely strong, well-reinforced ring construction.

Referring specifically to FIG. 3, the proximal end 112 of the safety latch 62 includes a small diameter recess 130 provided in outer surface 132 thereof. This small diameter recess is adapted to receive a small instrument (e.g., the point of a pen or pencil) therein, to provide a counterclockwise latch opening force on the safety latch 62, in the direction of arrow 134, as viewed in FIG. 3.

Referring to FIG. 2, it should be noted that the outer surface 132 of the safety latch 62 has a radius of curvature generally corresponding to the radius of curvature of the outer surfaces 44 and 28 of arcuate sections 12 and 14, to thereby provide, in cooperation with the arcuate sections, a substantially continuous curved outer surface when the ring is closed.

Referring to FIGS. 3 and 5, proximally facing surface 117 of the inwardly projecting section 116 engages the distal end 119 of tongue 64, to thereby force the tongue in a direction to the right (as viewed in FIG. 3) for partially disengaging the tongue and groove interconnection between the locking extensions 70 on arcuate section 14, on the one hand, and locking extensions 94 on the arcuate section 12, on the other hand. This separated condition of locking extensions is illustrated in both FIGS. 3 and 5, with the inwardly facing surfaces of tongues 98 engaging the flats 103 provided on the outwardly facing surfaces of tongues 102. Thereafter, the arcuate sections can be easily gripped by the wearer of the ring to complete the ring-opening operation.

METHOD OF FABRICATION

The ring 10 is formed by initially molding wax impressions of the various ring elements, and then employing the wax impressions in a conventional investment casting operation to form the actual ring parts, most preferably out of gold or other precious metal. For purposes of this application it is not necessary to describe the investment casting operation since it is a well-known and established technique. However, due to the intricacies of a number of the ring components, it may not be apparent to a person skilled in the art how the wax impressions of the ring segments are formed, and in particular, the manner in which the two arcuate segments 12 and 14 are formed.

In order to provide a complete disclosure of the best mode for carrying out this invention applicant will briefly describe the manner in which the wax impressions of the various ring elements are formed. As stated earlier, applicant will identify the various portions of the was impressions by the same numerals employed to describe the metal counterparts in the ring 10, since the configuration of each wax impression is substantially identical to the configuration of the precious metal part which is investment cast therefrom.

Figure 6:
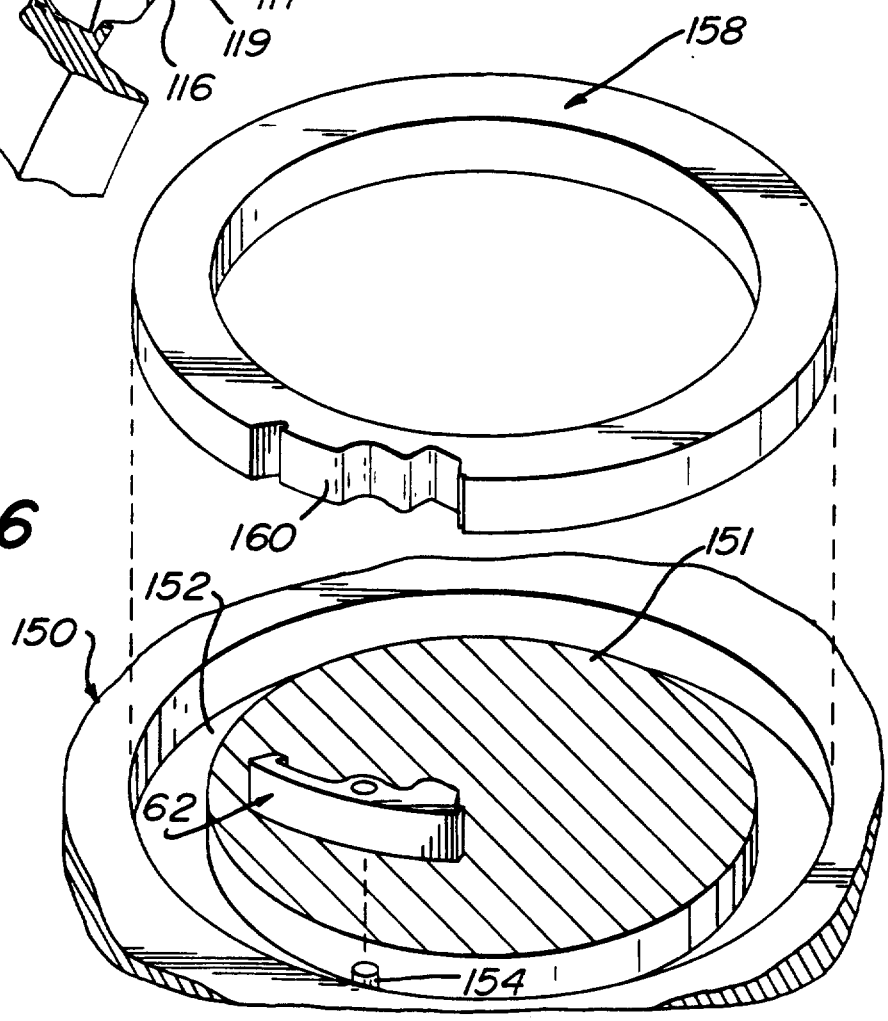
FIG. 6 is a schematic, fragmentary, exploded isometric view of mold sections employed in forming a wax impression of the safety latch of the latch mechanism of this invention and also the safety latch so formed.

Referring to FIG. 6, the manner in which the wax impression of the safety latch 62 is formed is illustrated. As is schematically illustrated in this FIG. 6, a lower mold section 150 cooperates with a central hub 151 forming part of an upper mold section to form an annular cavity 152. A pin 154, which also forms a part of the upper mold section, is positioned within the annular cavity 152, as is shown in FIG. 6, when the mold is in a closed condition.

Still referring to FIG. 6, a cavity insert 158 is provided to fill the annular cavity 152 except in the region occupied by section 160 of said cavity insert. The section 160 cooperates with the annular cavity 152 and the pin 154 to define the configuration of the safety latch 62, which can then be molded in a conventional manner from a wax impression material injected into the cavity 152 through a conventional sprue arrangement (not shown).

Referring to FIG. 7, the manner of forming the wax impression for the arcuate section 12 is illustrated. Specifically, the mold for forming this wax impression includes a lower mold section 170 which cooperates with a central hub 171 of an upper mold section to form an annular cavity 172 when the mold sections are closed. A vertically extending pin 174, which also is part of the upper mold section, is disposed to enter the cavity 172 in the region of the aligned openings 114, **114*a* to be formed in the tongue and groove locking extensions 94, into which the pivot pin 110** is to be received.

It should be understood that the pin 174 is of a shorter length than the depth of the annular cavity 172, to thereby form a complete opening 114 through one of the locking extensions 94, and only a blind opening **114*a* extending partially through the thickness of the other locking extension. As will be explained in greater detail hereinafter, the upper mold section is closed on the lower mold section 170 after radially slidable insert 186 is moved into the cavity 172 of the lower mold section 170**.

Still referring to FIG. 7, a second vertically oriented pin 176 extends vertically into the annular cavity 172 from the upper mold section, when the mold sections are closed, to thereby form the aligned openings 178 in the yolk 20. As explained earlier, these aligned openings 178 receive the pivot pin 18 therein.

Referring to the upper section of FIG. 7, three, relatively thin, substantially arcuate, plate-like inserts 180, 182 and 184 are positioned in the annular cavity 172, and cooperate with the cavity 172, the pin 174, the pin 176 and the radially slidable insert 186 to define the configuration of the arcuate section 12. Specifically, the outer arcuate plate-like inserts 180 and 184, which are identical, cooperate with the annular cavity 172 to define the open cavity configuration in which the tongue and groove portions of the locking extensions 94 are formed. In addition, these end inserts 180 and 184 cooperate with the annular cavity 172 to provide the configuration of the outer surfaces 38 of each of the leg sections 40 of the yolk 20.

The central, arcuate plate-like insert 182 and the radially slidable insert 186 cooperate with the annular cavity 172 to form the generally U-shaped recess 90 located between the tongue and groove extensions 94, with the bridge section 104 extending between said latter extensions. The pin 174, which preferably is part of the upper mold section is directed through the passageway 187 in the slidable insert 186, after the slidable insert is moved into the annular cavity 172.

After the various mold sections ar brought into engagement with each other the wax is injected into the annular cavity 172 through a conventional sprue (not shown) to form the wax impression of the arcuate section 12. After the wax impression is formed, the upper and lower mold sections are separated, the insert 186 is moved radially out of the cavity in which the wax impression was formed, and the wax impression is then removed from the lower mold section, after it hardens.

Referring to FIG. 8, the manner in which the wax impression of arcuate section 14 is formed, is illustrated. As can be seen in this figure the mold includes a lower mold section 200 which, in conjunction with a central hub section 201 of an upper mold section (not shown) defines an annular cavity 202 when the mold sections are closed.

A vertically extending pin 204, which also is part of the upper mold section, is located in the annular cavity 202 when the mold sections are closed. This pin 204 is employed to form the opening in the tang 22 of the arcuate section 14, into which pin 18 is received. After the wax impression of the arcuate section 14 has been formed, the mold sections are opened to permit easy removal of the wax impression.

Still referring to FIG. 8, three substantially thin, arcuate, plate-like inserts 206, 208 and 210 are positioned within the annular cavity 202. In addition, a radially slidable insert 212 is movable into alignment with the cavity 202 to cooperate with the cavity and the inserts 206, 208 and 210 to form the configuration of arcuate section 14.

Specifically, the arcuate end sections 206 and 210 are identical in configuration and cooperate with the annular cavity 202 to define the configuration of the tongue and groove locking extensions 70, and the surfaces 150 located on each side of the tang 22.

One end of the central arcuate insert 208 cooperates with confronting surfaces of the inserts 206 and 210, and includes a curved edge surface 202 to define an internal cavity between the spaced-apart inserts 206 and 210 conforming to the configuration of the tang 22. The other end of the insert 208 cooperates with the annular cavity 202 and the radially slidable insert 212 to define a cavity space conforming in configuration to the tongue 64, including the raised shoulder 72 thereon.

As explained earlier in connection with FIG. 7, after the wax impression of the arcuate extension 14 is formed, the mold sections are opened, to thereby remove the central hub 201 and the pin 204 from within the cavity 202.

The most significant feature in connection with molding the arcuate sections is that three separate, substantially thin cavity inserts are employed in conjunction with an annular cavity, to define the configuration of the two arcuate sections 12 and 14. It is this feature which a person skilled in the molding art might not fully appreciate, without the benefit of the above explanation. The other features employed in the mold, such as movable pins and radially slidable inserts are well known expedients in the molding art.

Without further elaboration the foregoing will so fully illustrate my invention that others may, by applying current or future knowledge, adopt the same for use under various conditions of service.

I claim:

1. A ring to be worn as an article of jewelry about a portion of a body of a person, said ring including first and second arcuate sections pivotally interconnected at one end for permitting pivotal movement of said arcuate sections between opened and closed positions, said arcuate sections, at the ends opposite the pivotal interconnection, each including latching members for cooperating with the latching members of the other arcuate section for releasably retaining the arcuate sections in a closed position, said arcuate sections, in a closed position, defining a closed ring having an inner closed surface defining an interior passage for receiving said portion of a body of a person, an outer closed surface defining the outer surface of the ring, and side surfaces defining the width of the ring, characterized in that:

A. said latch members on one of said arcuate sections being unitarily formed as part of said one of said arcuate sections and including:

(1) an elongate tongue forming a continuous extension of said one of said arcuate sections, said tongue terminating at a distal end and being narrower than the closed ring;

(2) a pair of locking extensions located on opposite sides of the tongue, each locking extension having a distal end which is located proximally of the distal end of the tongue and including male and female connecting sections;

B. said latch members on the other of said arcuate sections including:

(1) a pair of transversely spaced-apart locking extensions unitarily formed as part of said other of said arcuate sections, each of said locking extensions including male and female connecting sections;

(2) a bridge section unitarily formed as part of said other of said arcuate sections and constituting an extension of, and being joined to transversely spaced-apart, facing sidewalls of the pair of transversely spaced-apart locking extensions; and (3) a safety latch pivotally mounted between said pair of transversely spaced-apart locking extensions in a location proximally of said bridge section;

C. each of said pair of locking extensions on the other of said arcuate sections being transversely aligned with a respective locking extension of the pair of locking extensions on said one of said arcuate sections for causing the female and male connecting sections on each pair of locking extensions to interlock, respectively, with the male and female connecting sections of the other pair of locking extensions when the ring is closed;

D. said safety latch being movable about its pivotal mounting between opened and closed positions, said safety latch, in its closed position, having a distal end extending distally of said bridge member and being located in radial overlying relationship with a surface of said tongue for precluding inadvertent opening of said closed ring, said safety latch including a section located proximally of the pivotal mounting of said safety latch and proximally of said bridge member for engaging with the distal end of said tongue when the ring is in a closed position, whereby spring tension inherent in the tongue aids in maintaining the safety latch in a closed position.

2. The ring of claim 1 wherein said spring tension imposed by engagement of the tongue with the section of the safety latch located proximately of the pivotal mounting for maintaining the safety latch in a closed position, is maintained during a portion of the movement of the safety latch from its closed position in a direction toward its opened position.

3. The ring of claim 1, characterized in that the bridge member includes an outer surface located radially inward of the outer surface of the closed ring, said outer surface of the bridge member underlying the safety latch, in a region distally of the pivot mounting thereof, for engaging and limiting movement of the safety latch when said latch is moved into its closed position, said safety latch having an outer surface constituting part of the outer surface of the closed ring.

4. The ring of claim 3, characterized in that the bridge member includes a surface for frictionally engaging with a surface of the safety latch, when said safety latch is in an opened position, to assist in retaining the safety latch in said opened position.

5. The ring of claim 4, characterized in that the tongue is located inwardly of the bridge member, said tongue including an inner surface constituting part of the inner surface of the closed ring.

6. The ring of claim 4, characterized in that the safety latch includes a release section disposed proximally of its pivot mounting, said release section being engagable by an instrument for pivoting the safety latch into an opened position, said pivotal movement of the safety latch forcing the tongue engaged thereby in a direction for opening the ring, whereby the interlocked connection between the pairs of locking extensions is disengaged for permitting the ring to be easily manually opened.

7. The ring of claim 4, characterized in that the locking extensions of each pair are positioned so as to cause the male connecting section of each locking extension to flex slightly into snapping, interlocking engagement with a female connecting section of a cooperating locking extension when the arcuate sections of the ring are moved into the closed position.

8. The ring of claim 4, characterized in that said interior passage is provided by inner surfaces of said arcuate sections and some of said latch members; the outer surface of said ring being provided by outer surfaces of the arcuate sections and some of said latch members and side surfaces of the ring being provided by side surfaces of the arcuate sections and some of said latch members.

9. The ring of claim 1, characterized in that the bridge member includes a surface for frictionally engaging with a surface of the safety latch, when said safety latch is in an opened position, to assist in retaining the safety latch in said opened position.

10. The ring of claim 1, characterized in that the tongue is located inwardly of the bridge member, said tongue including an inner surface constituting part of the inner surface of the closed ring.

11. The ring of claim 1, characterized in that the safety latch includes a release section disposed proximally of its pivot mounting, said release section being engagable by an instrument for pivoting the safety latch into an opened position, said pivotal movement of the safety latch forcing the tongue engaged thereby in a direction for opening the ring, whereby the interlocked connection between the pairs of locking extensions is disengaged for permitting the ring to be easily manually opened.

12. The ring of claim 11, characterized in that at least one of the male connecting sections of one of the locking extensions includes a flat surface for engaging a corresponding male connecting section when the safety latch is moved into the opened position and the locking extensions are disengaged.

13. The ring of claim 1, characterized in that the locking extensions of each pair are positioned so as to cause the male connecting section of each locking extension to flex slightly into snapping, interlocking engagement with a female connecting section of a cooperating locking extension when the arcuate sections of the ring are moved into the closed position.

14. The ring of claim 1, characterized in that said interior passage is provided by inner surfaces of said arcuate sections and some of said latch members; the outer surface of said ring being provided by outer surfaces of the arcuate sections and some of said latch members and side surfaces of the ring being provided by side surfaces of the arcuate sections and some of said latch members.

15. The ring of claim 14, characterized in that the bridge member includes an outer surface located radially inward of the outer surface of the closed ring, said outer surface of the bridge member underlying the safety latch, in a region distally of the pivot mounting thereof, for engaging and limiting movement of the safety latch when said latch is moved into its closed position, said safety latch having an outer surface constituting part of the outer surface of the closed ring.

16. The ring of claim 14, characterized in that the bridge member includes a surface for frictionally engaging with a surface of the safety latch, when said safety latch is in an opened position, to assist in retaining the safety latch in said opened position.

17. The ring of claim 14, characterized in that the tongue is located inwardly of the bridge member, said tongue including an inner surface constituting part of the inner surface of the closed ring.

18. The ring of claim 14, characterized in that the safety latch includes a release section disposed proximally of its pivot mounting, said release section being engagable by an instrument for pivoting the safety latch into an opened position, said pivotal movement of the safety latch forcing the tongue engaged thereby in a direction for opening the ring, whereby the interlocked connection between the pairs of locking extensions is disengaged for permitting the ring to be easily manually opened.

19. The ring of claim 18, characterized in that at least one of the male connecting sections of one of the locking extensions includes a flat surface for engaging a corresponding male connecting section when the safety latch is moved into the opened position and the locking extensions are disengaged.

20. The ring of claim 14, characterized in that the locking extensions of each pair are positioned so as to cause the male connecting section of each locking extension to flex slightly into snapping, interlocking engagement with a female connecting section of a cooperating locking extension when the arcuate sections of the ring are moved into the closed position.

21. A ring to be worn as an article of jewelry about a portion of a body of a person, said ring including first and second arcuate sections pivotally interconnected at one end for permitting pivotal movement of the arcuate sections between opened and closed positions, each arcuate section including latching members, characterized in that the latching members on one arcuate section including an elongate tongue having a raised projection and a pair of locking extensions located on opposite sides of the tongue, each locking extension including male and female connecting sections, the latching members on the other arcuate section including a pair of locking extensions located on opposite sides of a central bridge member, said latching member on the other arcuate section including male and female connecting sections for engaging with the male and female connecting sections of the locking extension of said one arcuate section, said other arcuate section including a pivotally mounted safety latch which automatically is pivoted into an overlapping position with said raised projection on the tongue when the arcuate sections of the ring are moved into a closed position, with a section of the tongue underlying both the bridge member and the safety latch, and with the locking extensions on the one arcuate section engaging corresponding locking extensions on the other arcuate sections.

22. The ring of claim 21, characterized in that the bridge member includes an outer surface located radially inward of the outer surface of the closed ring, said outer surface of the bridge member underlying the safety latch, in a region distally of the pivot mounting thereof, for engaging and limiting movement of the safety latch when said latch is moved into its closed position, said safety latch having an outer surface constituting part of the outer surface of the closed ring.

23. The ring of claim 21, characterized in that the bridge member includes a surface for frictionally engaging with a surface of the safety latch, when said safety latch is in an opened position, to assist in retaining the safety latch in said opened position.

24. The ring of claim 21, characterized in that the tongue is located inwardly of the bridge member, said tongue including an inner surface constituting part of the inner surface of the closed ring.

25. The ring of claim 21, characterized in that the safety latch includes a release section disposed proximally of its pivot mounting, said release section being engagable by an instrument for pivoting the safety latch into an opened position, said pivotal movement of the safety latch forcing the tongue in a direction for opening the ring, whereby the connection between the pairs of locking extensions is disengaged for permitting the ring to be easily manually opened.

26. The ring of claim 25, characterized in that at least one of the male connecting sections of one of the locking extensions includes a flat surface for engaging a corresponding male connecting section when the safety latch is moved into the opened position and the locking extensions are disengaged.

27. The ring of claim 21, characterized in that the locking extensions of each pair are positioned so as to cause the male connecting section of each locking extension to flex slightly into snapping, interlocking engagement with a female connecting section of a cooperating locking extension when the arcuate sections of the ring are moved into the closed position.

* * * * *